US008540355B2

(12) United States Patent
Govyadinov et al.

(10) Patent No.: US 8,540,355 B2
(45) Date of Patent: Sep. 24, 2013

(54) FLUID EJECTION DEVICE WITH CIRCULATION PUMP

(75) Inventors: Alexander Govyadinov, Corvallis, OR (US); Andrew L. Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 389 days.

(21) Appl. No.: 12/833,984

(22) Filed: Jul. 11, 2010

(65) Prior Publication Data

US 2012/0007921 A1 Jan. 12, 2012

(51) Int. Cl.

| | |
|---|---|
| ***B41J 2/18*** | (2006.01) |
| ***B41J 2/04*** | (2006.01) |
| ***B41J 2/05*** | (2006.01) |
| ***B41J 2/19*** | (2006.01) |

(52) U.S. Cl.

USPC ..... 347/89; 347/54; 347/65; 347/92

(58) Field of Classification Search

None

See application file for complete search history.

(56) References Cited

U.S. PATENT DOCUMENTS

| | | | | |
|---|---|---|---|---|
| 5,818,485 | A | 10/1998 | Rezanka | |
| 6,227,660 | B1 | 5/2001 | McClelland et al. | |
| 6,244,694 | B1 * | 6/2001 | Weber et al. | 347/65 |
| 6,283,718 | B1 | 9/2001 | Prosperetti et al. | |
| 6,655,924 | B2 | 12/2003 | Ma | |
| 6,752,493 | B2 | 6/2004 | Dowell et al. | |
| 7,097,287 | B2 | 8/2006 | Nakao et al. | |
| 2007/0291082 | A1 * | 12/2007 | Baumer et al. | 347/68 |
| 2008/0055378 | A1 | 3/2008 | Drury et al. | |
| 2008/0143793 | A1 * | 6/2008 | Okuda | 347/68 |

* cited by examiner

*Primary Examiner* — Geoffrey Mruk

(74) *Attorney, Agent, or Firm* — Nathan R. Rieth

(57) ABSTRACT

A fluid ejection assembly includes a fluid slot, a plurality of drop generators, and a fluid circulation pump to circulate fluid from the fluid slot through each drop generator individually and back into the fluid slot.

11 Claims, 10 Drawing Sheets

FLUID EJECTION DEVICE WITH CIRCULATION PUMP

BACKGROUND

An inkjet printing device is an example of a fluid ejection device that provides drop-on-demand ejection of fluid droplets. In general, inkjet printing devices print images by ejecting ink droplets through a plurality of nozzles onto a print medium, such as a sheet of paper. The nozzles are typically arranged in one or more arrays, such that properly sequenced ejection of ink from the nozzles causes characters or other images to, be printed on the print medium as the printhead and the print medium move relative to each other. In a specific example, a thermal inkjet printhead ejects droplets from a nozzle by passing electrical current through a heating element to generate heat and vaporize a small portion of the fluid within a firing chamber. In another example, a piezoelectric inkjet printhead uses a piezoelectric material actuator to generate pressure pulses that force fluid droplets out of a nozzle.

Although inkjet printing devices provide high print quality at reasonable cost, continued improvement relies on overcoming various challenges that remain in their development. For example, air bubbles are a continuing problem in inkjet printheads. During printing, air from the ink is released and forms bubbles that can migrate from the firing chamber to other locations in the printhead and cause problems such as blocking ink flow, degrading the print quality, causing partly full print cartridges to appear empty, and ink leaks. In addition, pigment-ink vehicle separation (PIVS) remains a problem when using pigment-based inks. Pigment-based inks are preferred in inkjet printing as they tend to be more durable and permanent than dye-based inks. However, during periods of storage or non-use, pigment particles can settle or crash out of the ink vehicle (i.e., PIVS) which can impede or completely block ink flow to the firing chambers and nozzles in the printhead. Other factors such as evaporation of water (for aqueous inks) and solvent (for non-aqueous inks) can also contribute to PIVS and/or increased ink viscosity and viscous plug formation which prevent immediate printing after periods of non-use.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
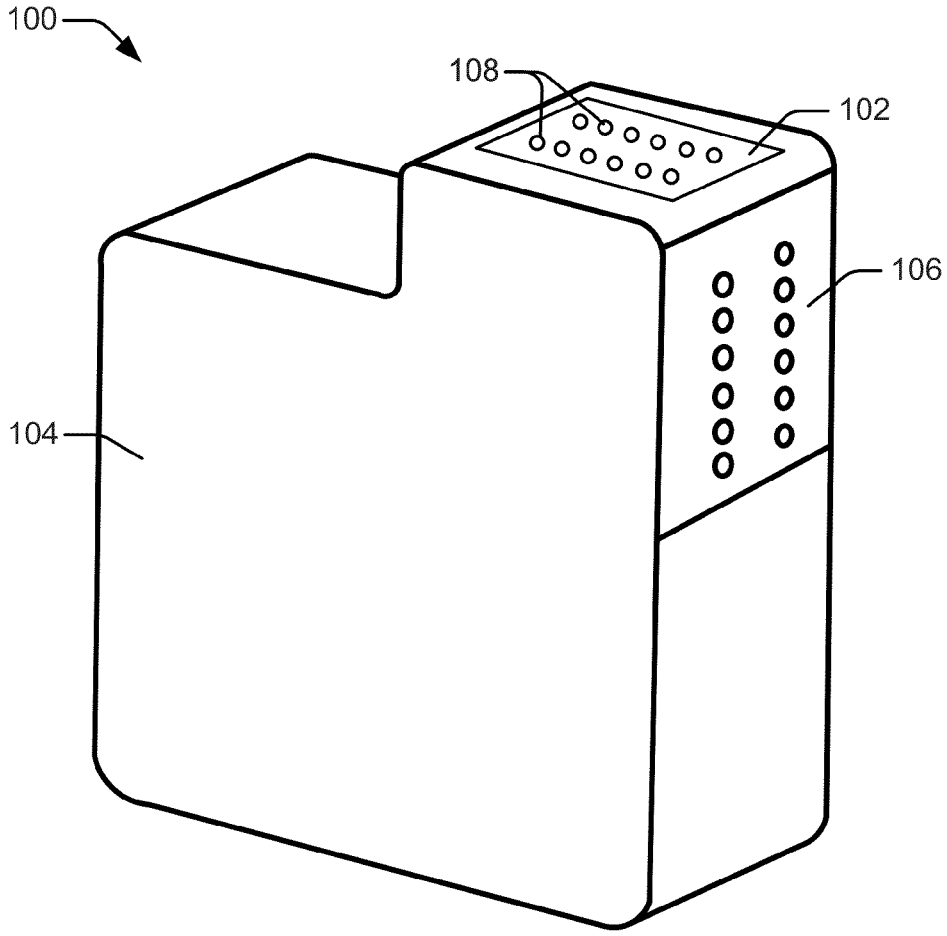
FIG. 1 shows an example of an inkjet pen suitable for incorporating a fluid ejection assembly, according to an embodiment.

As noted above, various challenges have yet to be overcome in the development of inkjet printing systems. For example, inkjet printheads used in such systems continue to have troubles with ink blockage and/or clogging. Previous solutions to this problem have primarily involved servicing the printheads before and after their use. For example, printheads are typically capped during non-use to prevent nozzles from clogging with dried ink. Prior to their use, nozzles are also primed by spitting ink through them. Drawbacks to these solutions include the inability to print immediately due to the servicing time, and an increase in the total cost of ownership due to the significant amount of ink consumed during servicing. Accordingly, ink blockage and/or clogging in inkjet printing systems remains a fundamental problem that can both degrade overall print quality and increase costs.

There are a number of causes for ink blockage or clogging in a printhead. One cause of ink blockage is an excess of air that accumulates as air bubbles in the printhead. When ink is exposed to air, such as while the ink is stored in an ink reservoir, additional air dissolves into the ink. The subsequent action of firing ink droplets from the firing chamber of the printhead releases excess air from the ink which then accumulates as air bubbles. The bubbles move from the firing chamber to other areas of the printhead where they can block the flow of ink to the printhead and within the printhead.

Pigment-based inks can also cause ink blockage or clogging in printheads. Inkjet printing systems use pigment-based inks and dye-based inks, and while there are advantages and disadvantages with both types of ink, pigment-based inks are generally preferred. In dye-based inks the dye particles are dissolved in liquid so the ink tends to soak deeper into the paper. This makes dye-based ink less efficient and it can reduce the image quality as the ink bleeds at the edges of the image. Pigment-based inks, by contrast, consist of an ink vehicle and high concentrations of insoluble pigment particles coated with a dispersant that enables the particles to remain suspended in the ink vehicle. This helps pigment inks stay more on the surface of the paper rather than soaking into the paper. Pigment ink is therefore more efficient than dye ink because less ink is needed to create the same color intensity in a printed image. Pigment inks also tend to be more durable and permanent than dye inks as they smear less than dye inks when they encounter water.

One drawback with pigment-based inks, however, is that ink blockage can occur in the inkjet printhead after shipping and prolonged storage, resulting in poor out-of-box performance of inkjet pens. Inkjet pens have a printhead affixed at one end that is internally coupled to a supply of ink. The ink supply may be self-contained within the pen body or it may reside on the printer outside of the pen and be coupled to the printhead through the pen body. Over long periods of storage, gravitational effects on the large pigment particles and/or degradation of the dispersant can cause pigment settling or crashing, which is known as PIVS (pigment-ink vehicle separation). The settling or crashing of pigment particles can impede or completely block ink flow to the firing chambers and nozzles in the printhead which can result in poor out-of-box performance by the printhead and reduced image quality.

Other factors such as evaporation of water and solvent from the ink can also contribute to PIVS and/or increased ink viscosity and viscous plug formation which prevent immediate printing after periods of non-use.

Embodiments of the present disclosure help to overcome the problem of ink blockage or clogging in inkjet printheads, generally through the use of a fluid ejection assembly having a fluid circulation pump. The fluid circulation pump is located asymmetrically (i.e., toward one end) along the length of a fluid channel. The pump circulates fluid from a fluid slot, through a plurality of drop generators disposed along the fluid channel, and back again into the fluid slot. Fluidic diodicity (i.e., a unidirectional flow of fluid) is achieved through the asymmetric location of the circulation pump within the fluid channel as well as the use of non-moving part valves. Fluid flows in a forward direction through the fluid channel and the drop generators, and then back into the fluid slot. The fluidic asymmetry of the channel and the non-moving part valves inhibit the flow of fluid in the reverse direction.

In one example embodiment, a fluid ejection assembly includes a fluid slot, a plurality of drop generators, and a circulation pump to circulate fluid from the fluid slot, through each drop generator individually, and then back into the fluid slot. A fluid channel is in fluid communication with the fluid slot through one inlet and a plurality of outlets, where each outlet corresponds with a particular drop generator. In another embodiment, a fluid ejection device includes an electronic controller to control fluid ejection from a fluid ejection assembly. The fluid ejection assembly includes a fluid slot in communication with a fluid channel, a plurality of drop generators disposed along the fluid channel, and a fluid circulation pump disposed asymmetrically within the fluid channel to circulate fluid from the fluid slot, through the fluid channel to each drop generator individually, and back into the fluid slot. In yet another embodiment, a method of circulating fluid within a fluid ejection device includes pumping fluid through a fluid ejection assembly with a pump located asymmetrically along the length of a fluid channel, and pumping the fluid to and from a fluid slot through the fluid channel and through a plurality of drop generators disposed along the fluid channel.

Illustrative Embodiments

FIG. 1 shows an example of an inkjet pen 100 suitable for incorporating a fluid ejection assembly 102 as disclosed herein, according to an embodiment. In this embodiment, the fluid ejection assembly 102 is disclosed as a fluid drop jetting printhead 102. The inkjet pen 100 includes a pen cartridge body 104, printhead 102, and electrical contacts 106. Individual fluid drop generators 210 (e.g., see FIG. 2) in printhead 102 are energized by electrical signals provided at contacts 106 to eject droplets of fluid from selected nozzles 108. The fluid can be any suitable fluid used in a printing process, such as various printable fluids, inks, pre-treatment compositions, fixers, and the like. In some examples, the fluid can be a fluid other than a printing fluid. The pen 100 may contain its own fluid supply within cartridge body 104, or it may receive fluid from an external supply (not shown) such as a fluid reservoir connected to pen 100 through a tube, for example. Pens 100 containing their own fluid supplies are generally disposable once the fluid supply is depleted.

Figure 2A:
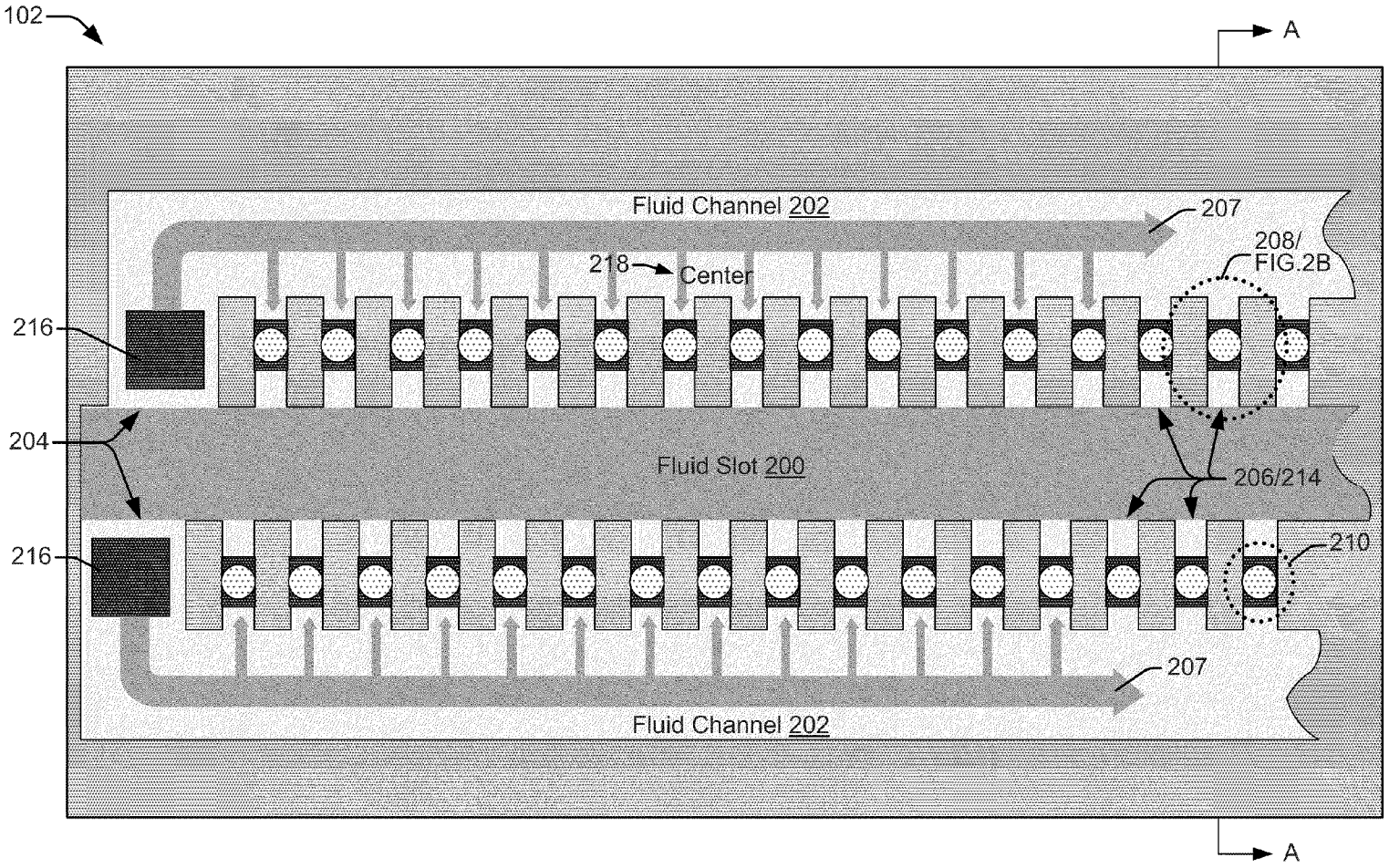
FIG. 2A shows a top down view of a partial fluid ejection assembly, according to an embodiment.

FIG. 2A shows a top down view of a partial fluid ejection assembly 102 (printhead 102), according to an embodiment of the disclosure. The assembly includes a fluid slot 200 that is in fluid communication with a fluid supply (not shown), such as a fluid reservoir. Fluid slot 200 is also in fluid communication with one or more fluid channels 202. Each fluid channel 202 has an inlet 204 through which fluid from fluid slot 200 flows into the channel 202. Each fluid channel 202 also has numerous outlets 206 through which fluid flows from the channel 202 back into the fluid slot 200, as generally indicated by the flow of grey arrows 207 in FIG. 2A. Each channel outlet 206 is associated with a smaller, drop generator channel 208. Each drop generator channel 208 is associated with a drop generator 210, as shown in FIG. 2B.

Figure 2B:
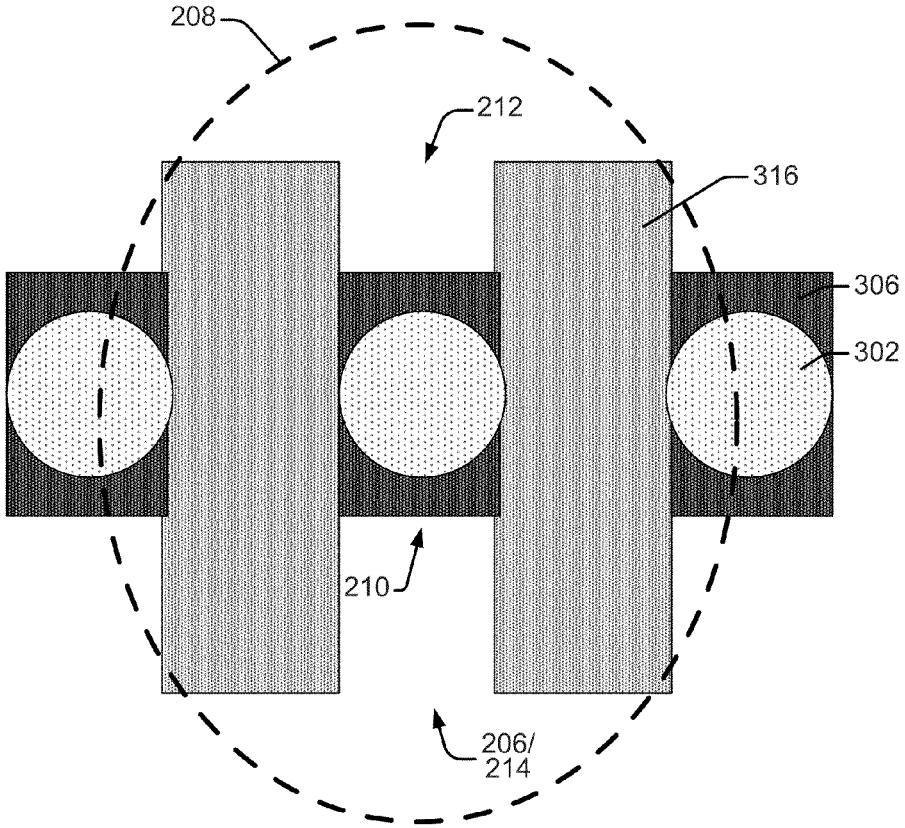
FIG. 2B shows a blow-up view of a drop generator channel, according to an embodiment.

FIG. 2B shows a blow-up view of a drop generator channel 208, according to an embodiment of the disclosure. As can be seen in FIG. 2B, each drop generator channel 208 includes a drop generator input 212, a drop generator output 214, and a drop generator 210 disposed between the input 212 and output 214. Thus, for each outlet 206 in the fluid channel 202, there is a corresponding drop generator 210 and drop generator channel 208. Furthermore, each fluid channel outlet 206 is the same as, or corresponds directly with, a drop generator output 214.

Referring again to FIG. 2A, a fluid circulation pump 216 is disposed in the vicinity of the inlet 204 to the fluid channel 202. In one embodiment, the fluid circulation pump 216 is a thermal resistor such as those generally employed as drop firing elements in a typical thermal inkjet printing system, and which is generally described herein below with reference to FIG. 3. Thus, fluid circulation pump 216 can be a thin film resistor stack including an oxide layer, a metal layer, conductive traces, and a passivation layer. In the case where the fluid circulation pump 216 is a thin film resistor pump 216, a fluid pumping action is achieved by energizing the resistor pump 216 with an electrical current. The current causes the resistor pump 216 to heat rapidly, which in turn superheats and vaporizes a thin layer of fluid in contact with the resistor pump 216. The expanding vapor bubble forces fluid away from the pump in both an upstream and downstream direction within the channel 202. As discussed below, however, the asymmetric placement of the pump 216 with respect to the length or center of the channel 202 results in a net flow of fluid toward the long side of the channel 202. Although the fluid circulation pump 216 is discussed as a thermal resistor element, in other embodiments it can be any of various types of pumping elements that may be suitably deployed in a channel 202 of a fluid ejection assembly 102. For example, in different embodiments fluid circulation pump 216 might be implemented as a piezoelectric actuator pump, an electrostatic pump, an electro hydrodynamic pump, or a peristaltic pump.

The exact location of the fluid circulation pump 216 within the fluid channel 202 may vary somewhat, but in any case will be asymmetrically located with respect to the center point of the length of the fluid channel 202. For example, assuming the length of a fluid channel 202 in FIG. 2A extends from the inlet 204 shown at the left side of FIG. 2A to the last outlet 206 shown at the right side of FIG. 2A, then the approximate "center" 218 of the channel 202 is located midway between the inlet 204 and last outlet 206, at center 218. Thus, the fluid circulation pump 216 is located asymmetrically with respect to the center 218 of the channel 202 toward the inlet 204 side of the channel 202. The asymmetric location of the fluid circulation pump 216 creates a short side of the channel 202 between the pump 216 and the fluid slot 200, and a long side of the channel 202 that extends toward the drop generator channels 208 and the channel center 218.

The asymmetric location of the fluid circulation pump 216 near the inlet 204, at the short side of the fluid channel 202, is the basis for the fluidic diodicity within the channel 202. The placement of the pump 216 asymmetrically toward the short side of the channel 202 results in a net fluid flow in a forward direction toward the long side of the channel 202, as generally indicated by the grey arrows 207 in FIG. 2A. The pumping action of the fluid circulation pump 216 creates a net fluid flow in a forward direction that moves fluid from the fluid slot 200 into the channel 202 at inlet 204, through the channel 202, and back into the fluid slot 200 through the numerous drop generator channels 208 and fluid channel outlets 206. Thus, the fluid ejection assembly 102 has one or more fluid circulation systems that each include the fluid slot 200, a fluid channel 202 with an inlet 204, a fluid circulation pump 216 disposed near the inlet 204 to the fluid channel 202, numerous drop generator channels 208 disposed along the length of the fluid channel 202 (each drop generator channel 208 including a drop generator input 212, a drop generator output 214, and a drop generator 210 disposed there between), and numerous fluid channel outlets 206 that each correspond with a drop generator output 214.

Figure 3:
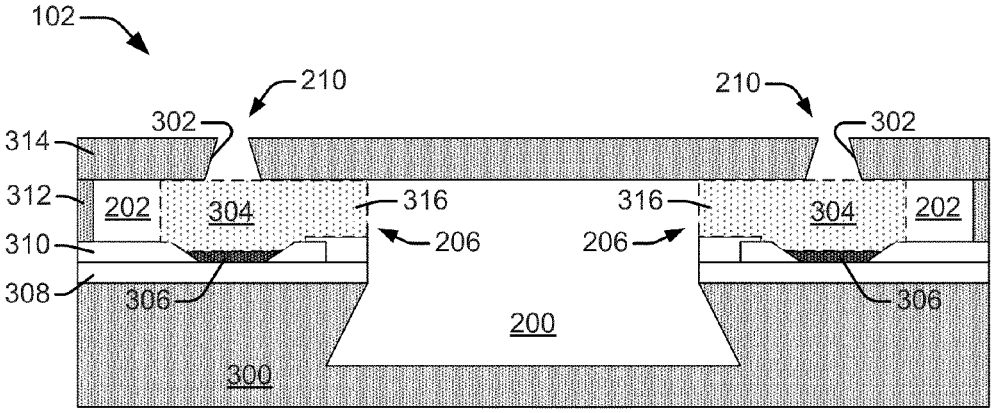
FIG. 3 shows a cross-sectional view of a fluid ejection assembly of FIG. 2A, according to an embodiment.
Figure 4A:
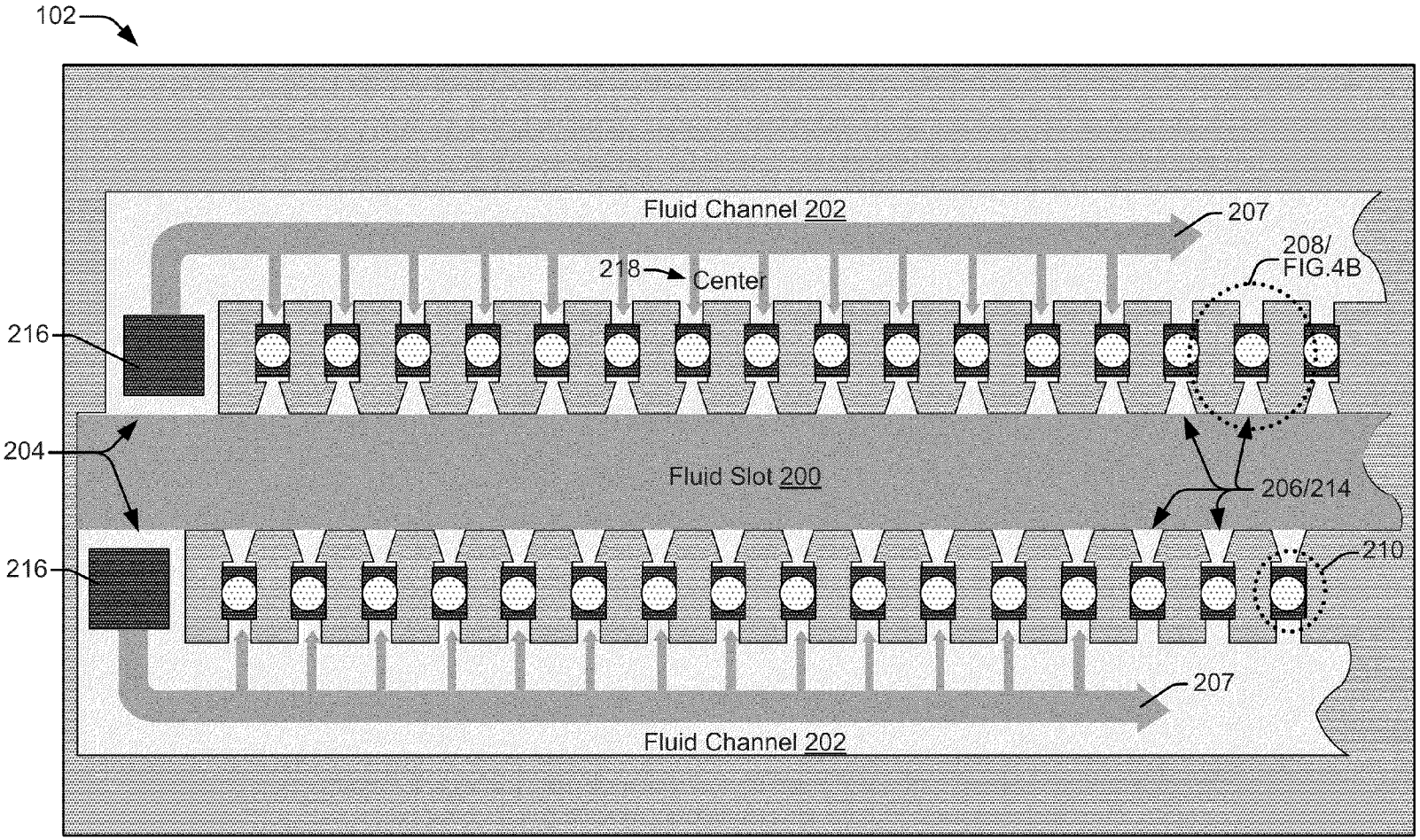
FIG. 4A shows a top down view of a partial fluid ejection assembly having non-moving part valves, accordingly to an embodiment.
Figure 4B:
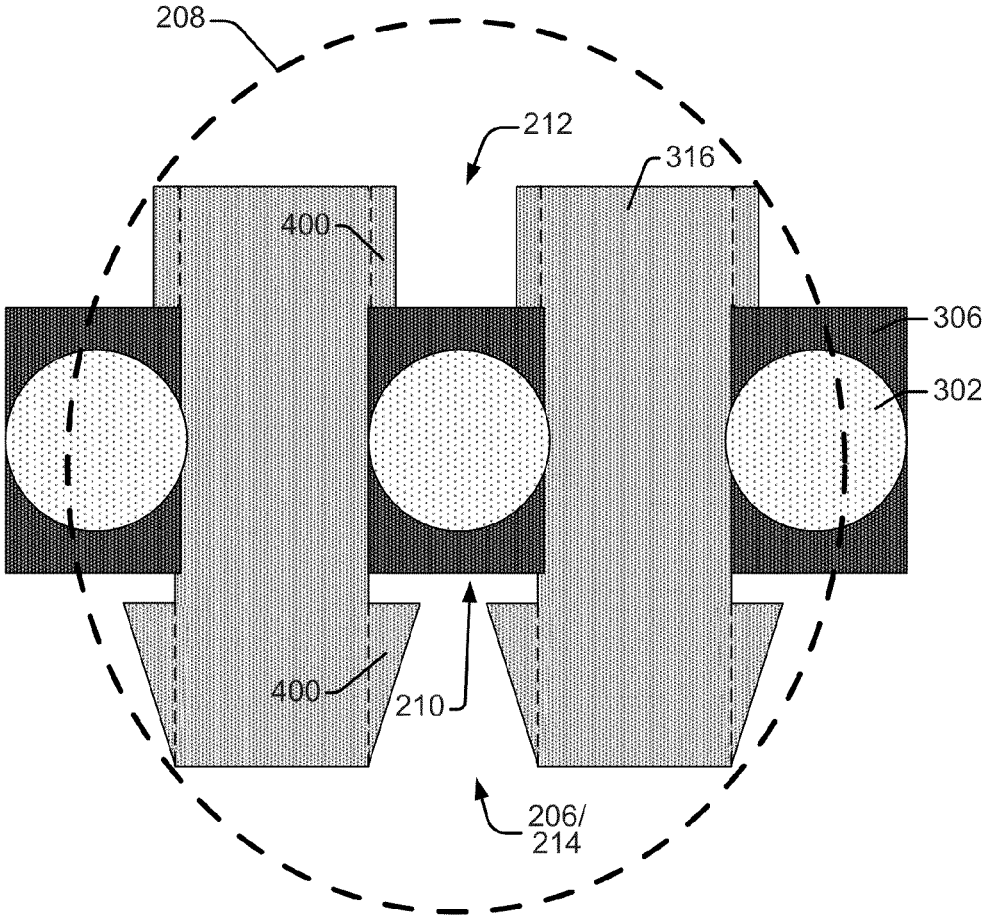
FIG. 4B shows a blow-up view of a drop generator channel that has non-moving part valves, according to an embodiment.

FIG. 3 shows a cross-sectional view of a fluid ejection assembly 102 (printhead 102) taken along line A-A of FIG. 2A, according to an embodiment of the disclosure. Fluid ejection assembly 102 includes a substrate 300 with fluid slot 200 formed therein, and a plurality of drop generators 210 on either side of the fluid slot 200 arranged along the lengths of the fluid slot 200 and the fluid channels 202 (the fluid slot 200 and fluid channels 202 extend into the plane of FIG. 3). Fluid slot 200 is an elongated slot extending into the plane that is in fluid communication with a fluid supply (not shown), such as a fluid reservoir. Fluid from fluid slot 200 flows into channels 202 through a single inlet 204 (not shown in FIG. 3 cross-section) for each channel 202, and then back to the fluid slot 200 through a plurality of outlets 206 corresponding to the plurality of drop generators 210. Each drop generator 210 includes a nozzle 302, a firing chamber 304, and a firing element 306 disposed in the firing chamber 304. Firing element 306 can be any device capable of operating to eject fluid drops through a corresponding nozzle 302, such as a thermal resistor or piezoelectric actuator. In the illustrated embodiment, firing element 306 is a thermal resistor formed of an oxide layer 308 on a top surface of the substrate 300 and a thin film stack 310 applied on top of the oxide layer 308. The thin film stack 310 generally includes an oxide layer, a metal layer defining the firing element 306, conductive traces, and a passivation layer. A chamber layer 312 having walls and chambers 304 separates the substrate 300 from a nozzle plate 314 having nozzles 302. Part of the chamber layer 312 are walls 316 defining and separating the plurality of drop generator channels 208.

During operation, a fluid droplet is ejected from a chamber 304 through a corresponding nozzle 302 by activating a corresponding firing element 306. The chamber 304 is then refilled with fluid circulating from fluid slot 200 and through channel 202 in preparation for ejecting another fluid droplet. For example, in a fluid ejection assembly 102 implementing thin film thermal resistor firing elements 306, electric current is passed through a resistor firing element 306 resulting in rapid heating of the element. A thin layer of fluid adjacent to the element 306 is superheated and vaporizes, creating a vapor bubble in the corresponding firing chamber 304. The rapidly expanding bubble forces a fluid droplet out of the corresponding nozzle 302. When the heating element cools, the vapor bubble quickly collapses, drawing more fluid into the firing chamber 304 in preparation for ejecting another drop from the nozzle 302.

FIGS. 4-8 show varying views of a fluid ejection assembly 102 with variations in the structure and/or layout of the fluid circulation pump 216, the fluid channels. 202, the fluid slot 200, and/or the drop generator channels 208, according to embodiments of the disclosure. FIG. 4A, for example, shows a top down view of a partial fluid ejection assembly 102 (printhead 102) having non-moving part valves (pinch points) in the drop generator channels 208, accordingly to an embodiment of the disclosure. The fluid ejection assembly 102 of FIG. 4A is similar to the assembly of FIG. 2A, except that the drop generator channels 208 include non-moving part valves at the drop generator inputs 212 and drop generator outputs 214. FIG. 4B shows a blow-up view of a drop generator channel 208 that has non-moving part valves 400, or pinch points 400, at the drop generator inputs 212 and drop generator outputs 214, according to an embodiment of the disclosure. The non-moving part valves 400 (distinguished in FIG. 4B by dashed lines) are affixed to, or are part of, the chamber walls 316 that define and separate the drop generator channels 208. The non-moving part valves 400 can be flanges on the walls 316 that have various shapes and locations to achieve different purposes. For example, the non-moving part valve flanges 400 in FIG. 4B are located around the drop generator 210 and are rectangular at the drop generator inputs 212 and semi-triangular and divergent away from the drop generators 210 at the drop generator outputs 214. However, other shapes and configurations are contemplated, such as non-moving part valve flanges 400 that converge toward the drop generator 210.

Such non-moving part valves 400 can facilitate or inhibit the flow of fluid in forward and reverse directions, contributing, for example, to fluidic diodicity. The pinch points resulting from such non-moving part valves 400 placed around drop generators 210 decreases crosstalk between nozzles 302, which improves print quality in inkjet printing systems. More specifically, the reduction in nozzle crosstalk is due to a decrease in fluid blow-back during drop ejection which results from having the non-moving part valves on either side of the drop generator. It is notable that the straight drop generator channels 208 in the embodiment of FIG. 2 provide a low micro-fluidic resistance that enables a high circulation flow uniformity across fluid slot 200. By contrast, the drop generator channels 208 with non-moving part valves in the FIG. 4 embodiment, while decreasing crosstalk between nozzles 302, decrease fluid circulation efficiency and provide a less uniform circulation flow across the fluid slot 200.

Figure 5:
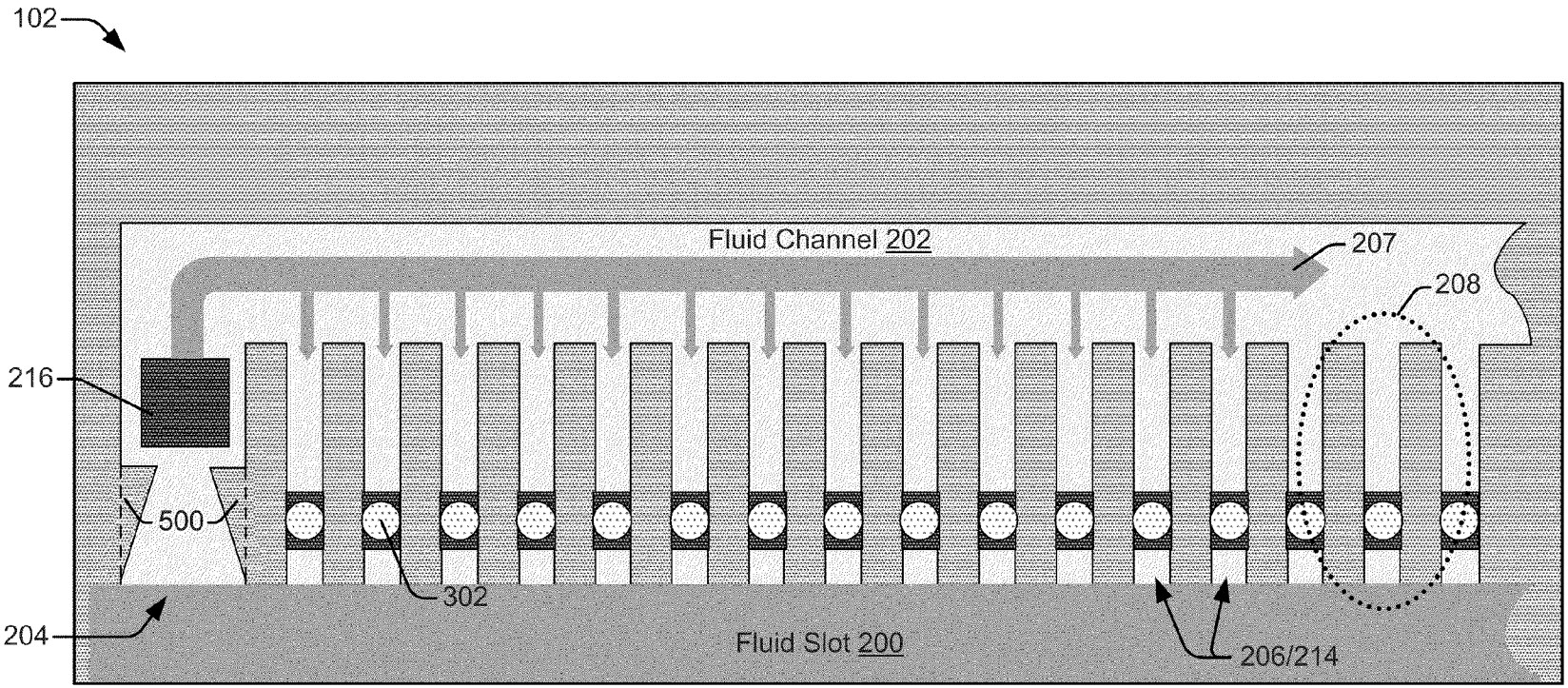
FIG. 5 shows a top down view of a partial fluid ejection assembly having elongated drop generator channels, according to an embodiment.

FIG. 5 shows a top down view of a partial fluid ejection assembly 102 having elongated drop generator channels 208, according to an embodiment of the disclosure. The assembly 102 also shows a fluid channel 202 inlet 204 that includes non-moving part valves (pinch points) 500 (distinguished by dashed lines) that promote fluidic diodicity. More specifically, the convergent shape of the non-moving part valves 500 into the channel 202 at the inlet 204 inhibits a reverse flow of fluid back into the fluid slot 200 from the pump 216, while contributing to a net fluid flow into the channel 202 in a forward direction as indicated by the grey arrows 207. The long drop generator channels 208 promote low crosstalk between nozzles 302 and a lower circulation efficiency. The lower circulation efficiency can be compensated for by a higher firing rate of the fluid circulation pump 216 to maintain a high circulation flow.

Figure 6:
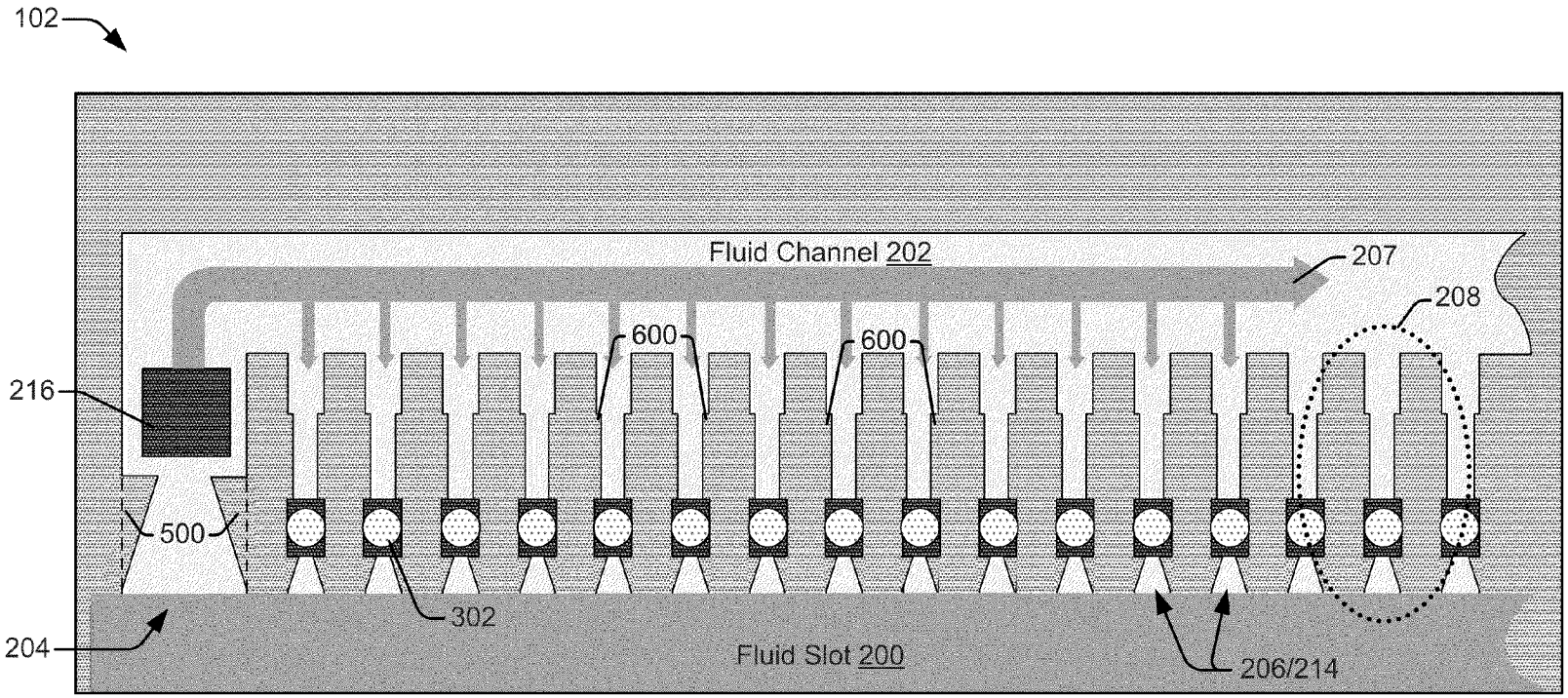
FIG. 6 shows a top down view of a partial fluid ejection assembly having elongated drop generator channels with elongated non-moving part valves, according to an embodiment.

FIG. 6 shows a top down view of a partial fluid ejection assembly 102 having elongated drop generator channels 208 with elongated non-moving part valves (pinch points) 600, according to an embodiment of the disclosure. The assembly 102 also shows a fluid channel 202 inlet 204 that includes non-moving part valves (pinch points) 500 (distinguished by dashed lines) that promote fluidic diodicity as discussed with respect to the embodiment of FIG. 5. The elongated drop generator channels 208 with elongated non-moving part valves promote very low crosstalk between nozzles 302 with a low circulation efficiency. The low circulation efficiency can be compensated for by a higher firing rate of the fluid circulation pump 216, in addition to additional pumps located in the corners of separated channels 202, as shown in FIG. 7.

Figure 7:
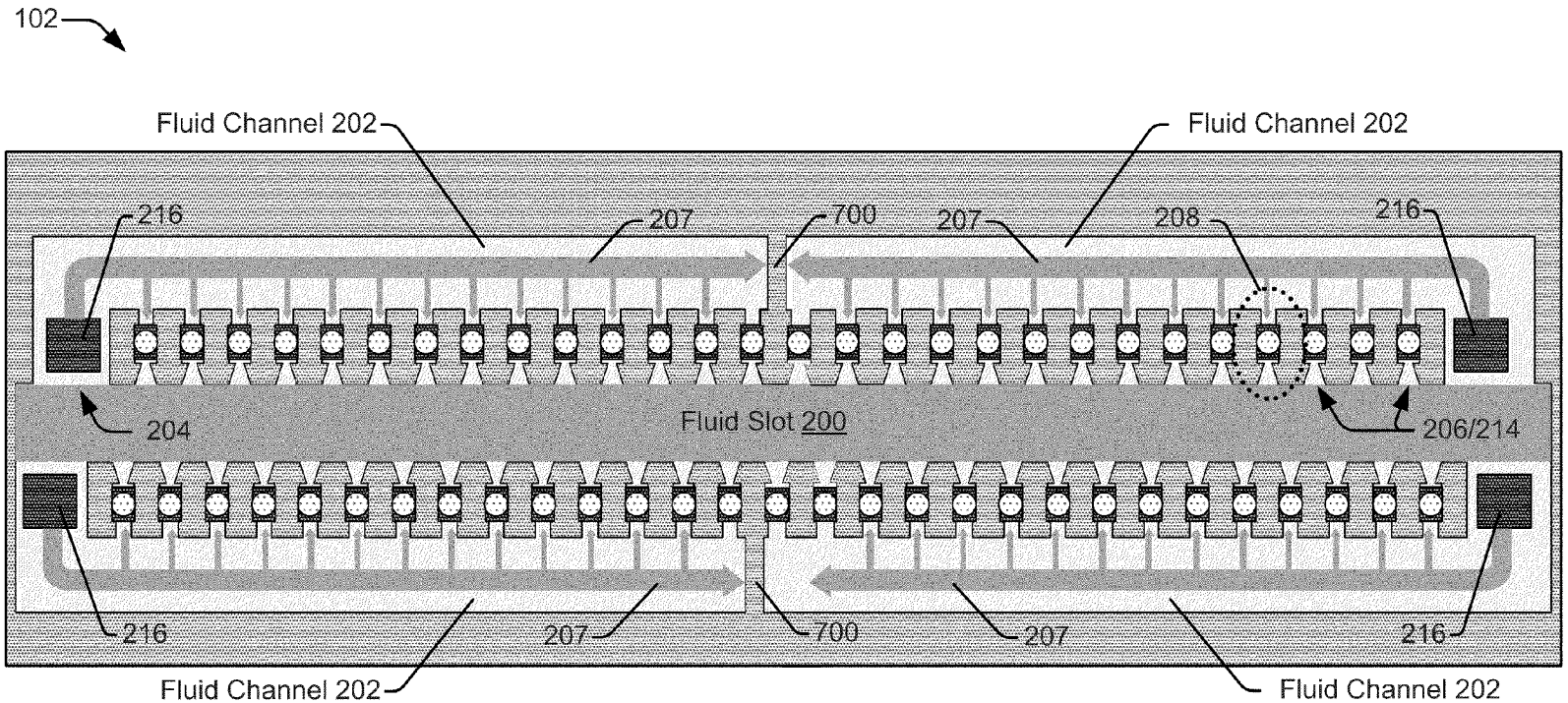
FIG. 7 shows a top down view of a fluid ejection assembly having fluid channels with channel barriers, according to an embodiment.

FIG. 7 shows a top down view of a fluid ejection assembly 102 having fluid channels with channel barriers, according to an embodiment of the disclosure. The channel barriers 700 divide each fluid channel 202 into two fluid channels to enable the placement of fluid circulation pumps 216 in each of four corners of the assembly 102. The additional pumps 216 enabled by this configuration promote higher fluid circulation flow that is useful, for example, in the case where non-moving part valves are used to decrease nozzle crosstalk and provide fluidic diodicity. As shown in FIG. 7, non-moving part valves provide pinch points at each drop generator 208. As noted, this decreases nozzle crosstalk and increase print quality in inkjet printing systems. However, the non-moving part valves also decrease fluid circulation efficiency. Thus, the additional pumps 216 enabled by channel barriers 700 compensate for the low circulation efficiency by increasing the fluid circulation flow rate. The embodiment in FIG. 7 represents one of various assembly architectures that are possible to create fluid circulation paths that can provide the benefits of fluid circulation in a fluid ejection assembly 102.

Figure 8:
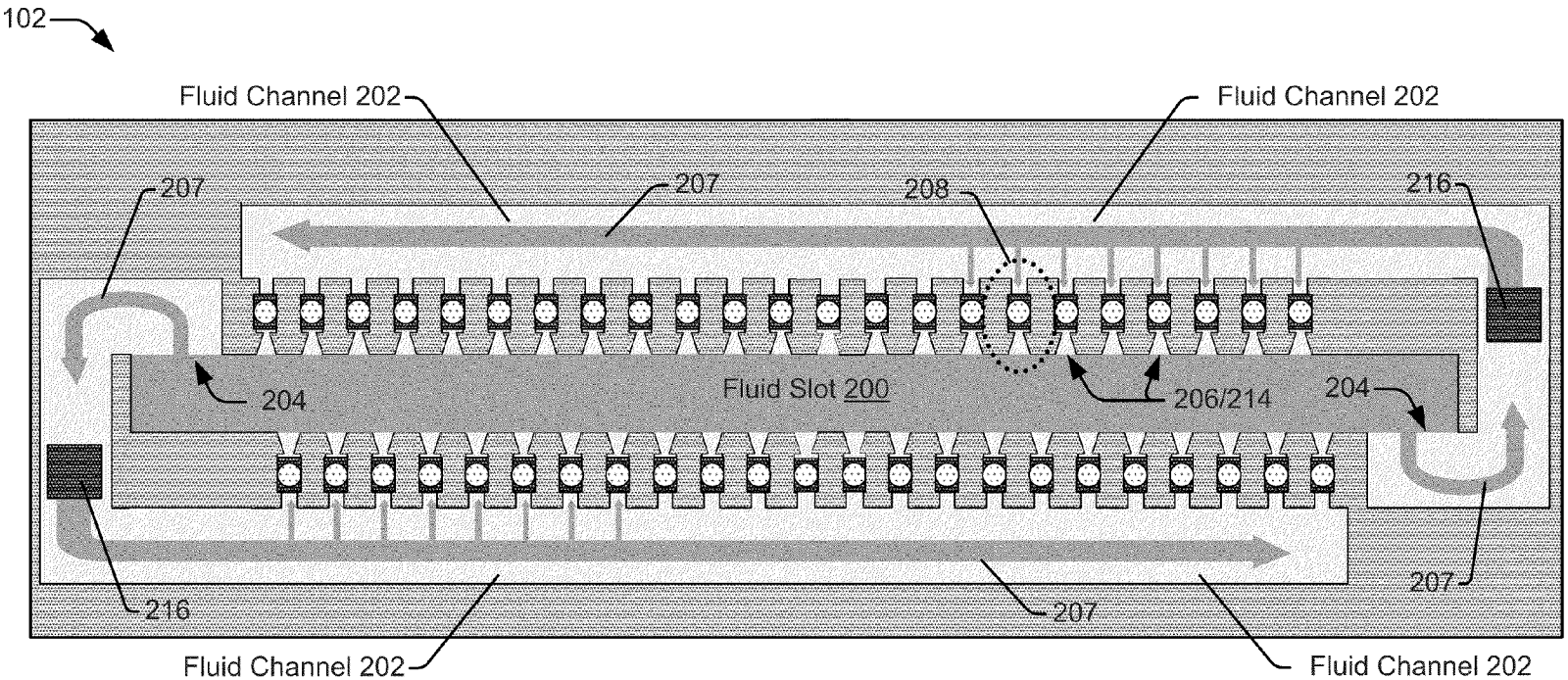
FIG. 8 shows a top down view of a fluid ejection assembly having elongated fluid circulation loops, according to an embodiment.

FIG. 8 shows a top down view of a fluid ejection assembly 102 having elongated fluid circulation loops, according to an embodiment of the disclosure. In this configuration, a fluid circulation pump 216 is placed at both ends of the fluid slot 200 just inside the inlet 204 to fluid channels 202. The embodiment in FIG. 8 represents another of various assembly architectures that are possible to create fluid circulation paths that can provide the benefits of fluid circulation in a fluid ejection assembly 102.

Figure 9:
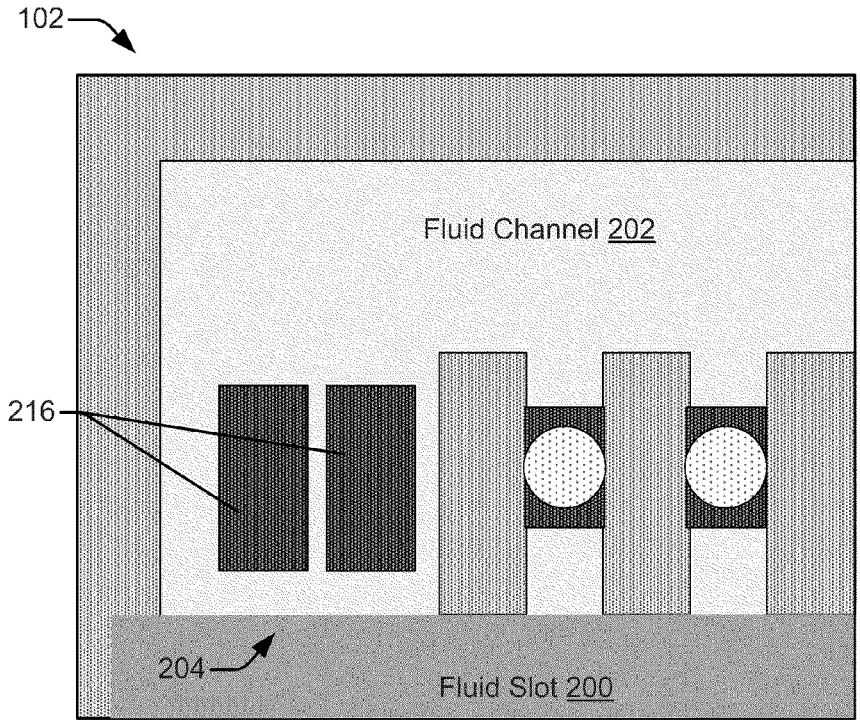
FIG. 9 shows a top down view of a fluid ejection assembly having a fluid circulation pump that consists of multiple fluid circulation pumps, according to an embodiment.

FIG. 9 shows a top down view of a fluid ejection assembly 102 having a fluid circulation pump 216 that consists of multiple fluid circulation pumps 216, according to an embodiment of the disclosure. Although only two pumps 216 are illustrated in FIG. 9, additional pumps are possible and are contemplated. Multiple parallel pumps 216, such as multiple parallel thermal resistor pumps 216, can be activated separately or together to control pump characteristics, such as the pump timing and power to generate varying fluid circulation flow rates through varying fluid vaporization energies. For example, for a multiple thermal resistor pump 216, all of the resistors can be energized at the same time to create a larger vapor bubble more quickly. Likewise, different resistors can be energized at different times, for example, to provide smaller vapor bubbles or vapor bubbles that occur at different times relative to one another.

Figure 10:
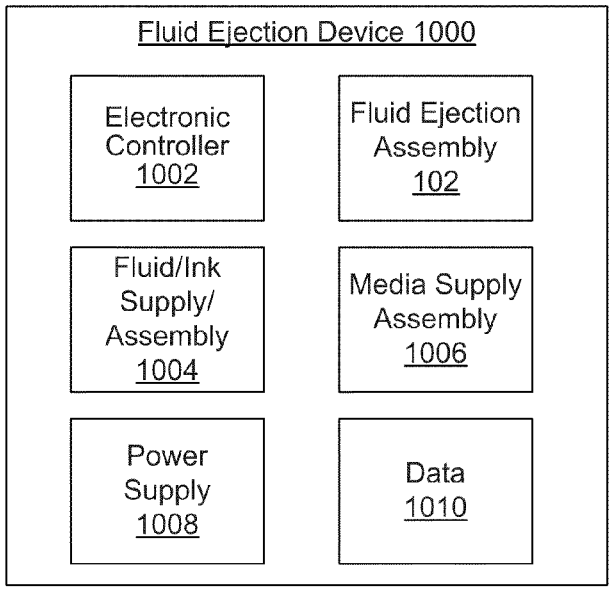
FIG. 10 shows a block diagram of a basic fluid ejection device, according to an embodiment.

FIG. 10 shows a block diagram of a basic fluid ejection device, according to an embodiment of the disclosure. The fluid ejection device 1000 includes an electronic controller 1002 and a fluid ejection assembly 102. Fluid ejection assembly 102 can be any embodiment of a fluid ejection assembly 102 described, illustrated and/or contemplated by the present disclosure. Electronic controller 1002 typically includes a processor, firmware, and other electronics for communicating with and controlling assembly 102 to eject fluid droplets in a precise manner.

In one embodiment, fluid ejection device 1000 may be an inkjet printing device. As such, fluid ejection device 1000 may also include a fluid/ink supply and assembly 1004 to supply fluid to fluid ejection assembly 102, a media transport assembly 1006 to provide media for receiving patterns of ejected fluid droplets, and a power supply 1008. In general, electronic controller 1002 receives data from a host system, such as a computer. The data represents, for example, a document and/or file to be printed and forms a print job that includes one or more print job commands and/or command parameters. From the data, electronic controller 1002 defines a pattern of drops to eject which form characters, symbols, and/or other graphics or images.

What is claimed is:

1. A fluid ejection assembly comprising:
- a substrate;
- a fluid slot formed in the substrate;
- a nozzle plate;
- a chamber layer between the nozzle plate and the substrate;
- a fluid channel defined by the chamber layer that begins at a single inlet and ends at a plurality of outlets, the inlet and outlets in communication with the fluid slot;
- a plurality of drop generators corresponding with the plurality of outlets; and
- a fluid circulation pump formed on the substrate within the fluid channel to circulate fluid from the inlet and through each drop generator and corresponding outlet.

2. A fluid ejection assembly as in claim 1, wherein the fluid circulation pump is located asymmetrically with respect to a central point along the fluid channel.

3. A fluid ejection assembly as in claim 1, further comprising for each drop generator, a drop generator channel that extends from the fluid channel to the fluid slot, the drop generator channel comprising:
- a drop generator input in communication with the fluid channel;
- a drop generator output in communication with the fluid slot; and
- a drop generator disposed between the drop generator input and the drop generator output.

4. A fluid ejection assembly as in claim 3, wherein the drop generator channel comprises pinch points on either side of the drop generator to decrease blow-back of fluid during drop ejection.

5. A fluid ejection assembly as in claim 1, wherein the fluid circulation pump is disposed adjacent to the fluid slot at the inlet to the fluid channel.

6. A fluid ejection assembly as in claim 1, comprising multiple fluid channels separated in part by channel barriers and a fluid circulation pump associated with each fluid channel, wherein each pump is associated with a different plurality of drop generators to circulate fluid from the fluid slot and back into the fluid slot through each drop generator in its associated different plurality of drop generators.

7. A fluid ejection assembly as in claim 6, comprising a shared fluid circulation path whereby fluid circulating back into the fluid slot through drop generators of a first plurality of drop generators mixes with fluid circulating back into the fluid slot through drop generators of a second plurality of drop generators.

8. A fluid ejection assembly as in claim 1, wherein the fluid circulation pump comprises multiple thermal resistors capable of independent control to generate varying fluid circulation flow rates through varying fluid vaporization energies.

9. A fluid ejection assembly as in claim 1, wherein the pump is selected from a group of pumps consisting of a thermal resistor pump, a piezoelectric actuator pump, an electrostatic pump, an electro hydrodynamic pump, and a peristaltic pump.

10. A fluid ejection assembly as in claim 1, wherein each drop generator comprises:

a fluid chamber defined by the chamber layer;

an ejection element formed on the substrate; and a nozzle outlet formed in the nozzle plate through which the ejection element forces fluid from the fluid chamber.

11. A fluid ejection assembly as in claim 1, further comprising:

an electronic controller to control fluid ejection from the plurality of drop generators.

* * * * *